US006039416A

United States Patent [19]

Lambert

[11] Patent Number: 6,039,416

[45] Date of Patent: Mar. 21, 2000

[54] WALL MOUNTED PIVOTING WORK BENCH

[76] Inventor: Jeffrey W. Lambert, 1571 Greyson Ridge, Marietta, Ga. 30062

[21] Appl. No.: 09/262,888

[22] Filed: Mar. 8, 1999

[51] Int. Cl.[7] ..... A47F 5/08

[52] U.S. Cl. ..... 312/245; 312/314; 108/48; D6/430

[58] Field of Search ..... 312/245, 246, 312/248, 242, 315, 314, 316, 317.3; 108/42, 48, 132, 134; 211/90, 99, 104; D6/429, 430

[56] References Cited

U.S. PATENT DOCUMENTS

| | | | |
|---|---|---|---|
| D. 191,272 | 9/1961 | Ungaro | D6/430 |
| D. 263,533 | 3/1982 | Ferninand et al. . | |
| D. 293,403 | 12/1987 | Umanoff et al. | D6/430 X |
| 2,755,156 | 7/1956 | Nichols | 312/314 |
| 4,155,609 | 5/1979 | Skafte et al. | 312/245 |
| 4,256,294 | 3/1981 | Hickman et al. . | |
| 4,313,385 | 2/1982 | Fitzgerald | 108/48 X |
| 4,501,457 | 2/1985 | Pond | 312/314 |
| 4,856,435 | 8/1989 | Larson | 108/48 X |
| 4,919,498 | 4/1990 | Turner | 312/245 X |
| 5,170,719 | 12/1992 | Pestone | 108/48 |
| 5,408,936 | 4/1995 | Tseng | 108/42 |
| 5,513,574 | 5/1996 | Collins | 108/48 X |
| 5,655,459 | 8/1997 | O'Connor et al. | 108/48 |
| 5,707,126 | 1/1998 | Neufeld et al. | 312/245 |

FOREIGN PATENT DOCUMENTS

| | | | |
|---|---|---|---|
| 1199842 | 12/1959 | France | 312/314 |

*Primary Examiner*—Peter M. Cuomo
*Assistant Examiner*—James O. Hansen
*Attorney, Agent, or Firm*—William B. Noll

[57] ABSTRACT

A space saver, pivotal work bench assembly comprising a fixed tool storage housing mounted on a wall, and a pivotal work bench having pivotal and lockable legs. In a preferred embodiment, cooperative latching members are provided between the tool storage housing and pivotal work bench to temporarily secure the assembly to the wall.

7 Claims, 2 Drawing Sheets

WALL MOUNTED PIVOTING WORK BENCH

FIELD OF THE INVENTION

This invention is directed to the field of pivotal, wall mounted work benches, such as for use in a garage where space may be at a premium.

BACKGROUND OF THE INVENTION

The present invention relates to a wall mounted pivoting work bench, where the work bench may be pivoted to provide an essentially horizontal work surface, while including tool storage means readily accessible to the user thereof Further, since space may be at a premium, the work bench may be pivoted to lie essentially contiguous with the wall and secured thereagainst during periods of nonuse.

The prior art, as reflected in the following U.S. Patents, offers some space saving advantages for wall pivotally mounted work surfaces, but none offer the advantages of the present invention. Such prior art is as follows:

a.) U.S. Pat. No. 5,707,126, to Neufeld, et al., teaches a self-retracting wall-mounted desk and chart holder especially useful as a decentralized nurses'station having a slim profile, compact construction, and being specifically designed for mounting on walls outside patient rooms. The chart holder includes a body having structure for defining a side entry storage slot of sufficient width to receive a medical chart standing on edge and extending parallel to the wall on which the chart holder is mounted. The slot is shorter than the chart so that a portion of the chart may project out beyond the slot and above the slot to make it visible at-a-glance. The chart holder further includes a desktop which is swimgably attached to the body for movement of the desktop between a horizontal open position for use as a work surface, and a vertical closed position.

b.) U.S. Pat. No. 5,170,719, to Pestone, relates to a portable, collapsible workbench which may be secured to the upper edge of a door. A perforated back panel is provided with tubes secured to opposite edges, the tops of the tubes having clamps to be attached to the door. A benchtop is pivotally secured to the lower ends of the tubes. The benchtop is pivoted between a horizontal position in use and a vertical position below the back panel for storage. Legs are pivotally secured to the end of the benchtop opposite the tube to support the benchtop in the horizontal position. The legs are folded parallel to the benchtop in the vertical position.

c.) U.S. Pat. No. 4,856,435, to Larson, is directed to a stowable workbench adapted to be mounted on a tool box having a flat work surface movable between a working position in which it extends laterally from the work bench, and a stowage position in which it extends perpendicular to the work bench.

d.) U.S. Pat. No. 4,256,294, to Hickman, et al., relates to a portable workbench and carrying case therefor and includes front and rear vise beams, a pair of independently operable vise screw rods for moving the vise beams relatively towards and away from one another, and a six-sided case that is foldable between a closed, carrying condition in which it encloses the workbench and an open, use position in which it is adapted to overlie a table-top and cooperate therewith to facilitate use of the workbench.

e.) U.S. Pat. No. 4,155,609, to Skafte, et al., teaches a wall-hung cabinet comprising a body portion fixedly attached to a wall. A door is hingedly mounted to the body portion and equipped to independently store items therein. A foldable work bench extends from the bottom body portion of the cabinet. In one embodiment, the bottom of the cabinet is at approximately table height. In another embodiment the cabinet extends practically to the floor. The top of the cabinet is approximately no higher than the reach of an average person. Thus, the wall-hung cabinet provides an ideal and compact unit for storing and making use of craft and hobby tools and apparatus.

f.) U.S. Pat. No. 2,755,156, to Nichols, is directed to a compact portable desk which, when in its folded, storage or transporting condition, is of a size substantially equal to a suitcase and is formed so as to resemble a suitcase and to be handled in the same way as a suitcase.

g.) U.S. Pat. No. D-263,533, to Ferdinand et al., is a design patent illustrating a foldaway workshop.

The present invention offers space saving advantages and conveniences not found in the above prior art. The manner by which these advantages and conveniences are achieved will become apparent in the specification which follows, particularly when read in conjunction with the accompanying drawings.

SUMMARY OF THE INVENTION

This invention is directed to a pivotal work bench for mounting to an essentially vertical wall. In a preferred embodiment the work bench comprises a generally rectangular member to be secured to the wall and comprising a peg-board having an array of apertures for receiving plural tool mounting fixtures. Extending about the periphery of the peg-board is a box-like structure along a first side of the peg-board., and a spacer member attached to a second side of the peg-board in contact with the wall. By the use of the spacer, the respective fixtures may be easily mounted to the peg-board at a variety of locations. Further, a second, generally rectangular work bench member is hingedly secured to the box-like structure, where the work bench member includes a pair of hingedly mounted legs. Each leg includes a lockable hinge support to temporarily secure its respective leg in supporting relationship to the work bench member. A simpler second embodiment is also disclosed, where the generally rectangular member is secured directly to the wall, i.e. no wall spacer.

Accordingly, an object of this invention is to provide a space saver, pivotally mounted work bench that may be pivoted from a working position, to a non-working or stored position adjacent a wall.

Another object hereof is the provision of a convenient and accessible means to store tools for use in activities at the work bench.

Still a further object of this invention lies in the use of temporarily lockable leg supports to provide stability to the work bench hereof These and other objects of the invention will become apparent to those skilled in the art from the following description.

DETAILED DESCRIPTION OF PREFERRED EMBODIMENT

Figure 1:
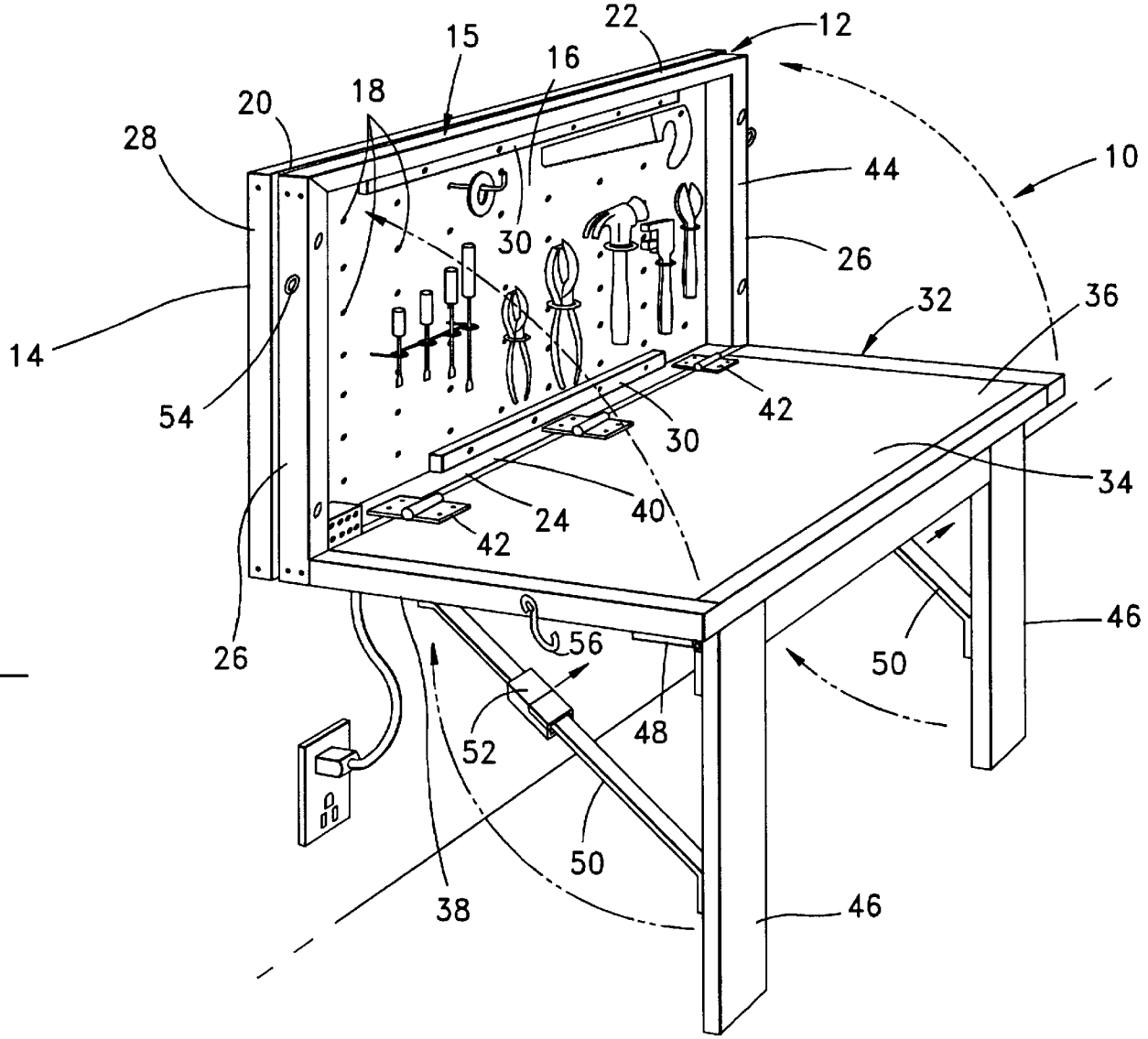
FIG. 1 is a perspective view of the open or usable wall mounted work bench according to the present invention, showing further directional arrows for closing and storing the work bench.

The invention relates to a pivotal and storable work bench that offers all the work advantages of a static work bench structure, while affording the user thereof the convenience of pivoting and storing the assembly to make room for other desired activities. The manner by which these goals are found in the present invention will become evident in the further description and drawings, where like reference numerals represent like components or features throughout the several views.

Figure 3:
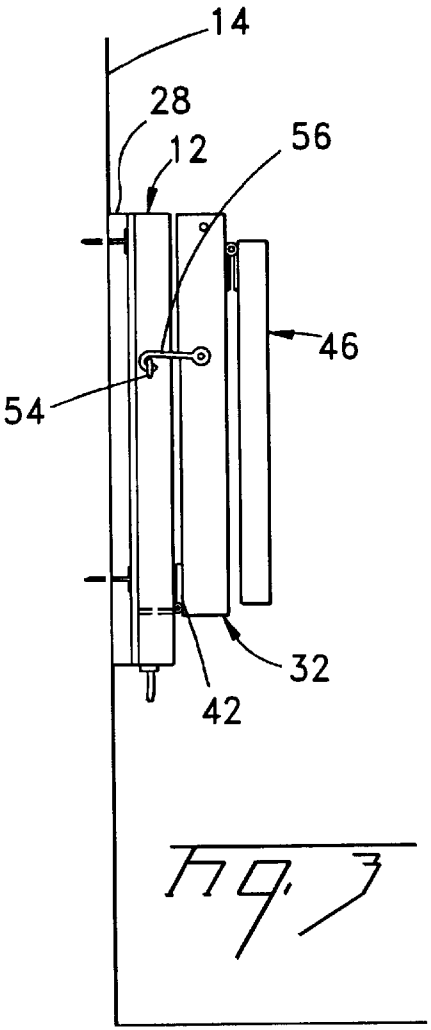
FIG. 3 is a side view of the work bench of FIG. 1 in a closed and stored position.
Figure 2:
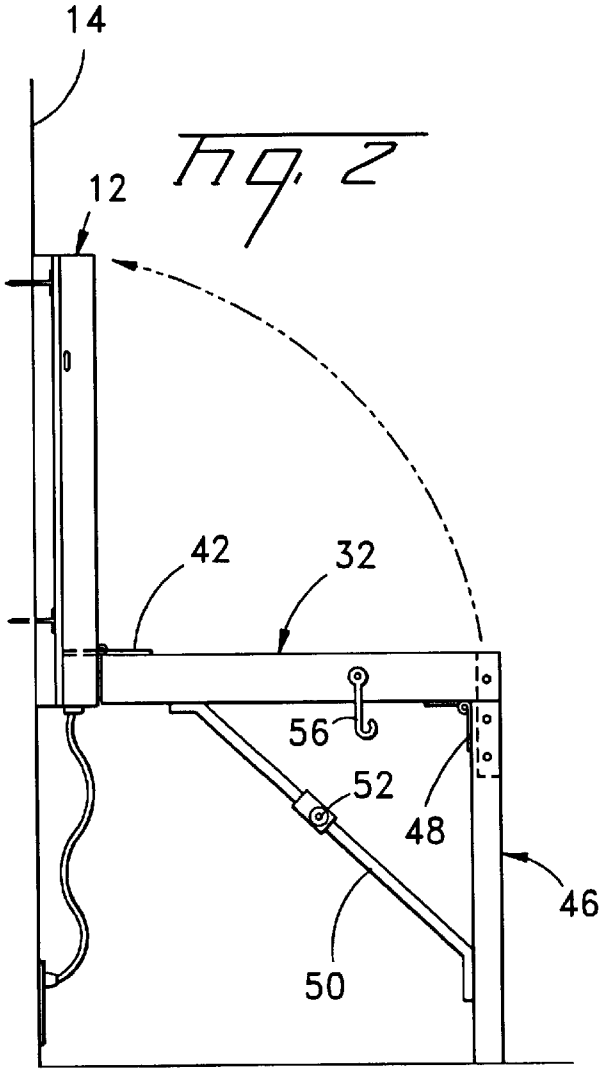
FIG. 2 is a side view of the wall mounted pivotal work bench of FIG. 1.

Turning now to the preferred embodiment of FIGS. 1 through 3, the work bench assembly 10 of this invention comprises a first, generally rectangular member 12 to be fixed or secured to an essentially vertical wall 14. The member 12 may comprise a box-like structure 15 made up of a peg-board base 16, having an array of apertures 18, as known in the art, for selectively receiving and positioning a plurality of tool receiving fixtures for storing and displaying a variety of tools, see FIG. 1. Extending outwardly from the periphery 20 of the peg-board base 16, are upper and lower horizontal members 22, 24, respectively, and a pair of vertical side members 26, whereby to define a recess for the various tools to be stored. Extending rearwardly, or toward the wall 14, from the peg-board base 16 is a spacer member 28, which may take the form of a rectangular frame member. By providing the spacer member, the user of the work bench assembly may easily and selectively position the various tool receiving fixtures, as known in the art. Finally, as a convenient means to secure the generally rectangular member 12 to the wall 14, upper and lower attaching blocks or strips 30 may be provided.

Hingedly secured to the generally rectangular member 12 is the pivotal work bench 32. The pivotal work bench 32 comprises a planar member 34, essentially sized to be coextensive with said box-like structure 15, where said planar member includes an upper or working surface 36, and a lower surface 38. When properly positioned relative to the box-like structure 15, the upper surface 36 is planarly aligned with the inner surface 40 of the lower horizontal member 24. In this relationship, at least a pair of hinges 42 may be provided to hingedly secure the work bench 32 to the box-like structure 15, with the hinges fastened to said inner surface and said planar upper surface. That is, by this arrangement, the work bench 32 may be pivoted upwardly to lie contiguous with the outer surface 44 of the box-like structure. This will become clearer hereafter.

However, to support the work, bench 32 as a suitable work station, a pair of pivotal legs 46 are provided. Each leg 46 is secured, such as by hinge 48, to the lower surface 38 by fasteners, not shown. Since a primary feature hereof is to provide a compact and unobtrusive assembly when stored, the hinges 48 allow the legs 46 to pivot toward and in contact with the lower surface 38. Further, since safety and security are always a concern when working with tools, a stable structure is essential. In this regard, a lockable hinge support 50 may be provided for each leg 46. The hinge supports 50, well known in the art, may include a sliding sleeve 52 to override the hinge joint, when in use, to prevent an accidental or premature dislodging of one or both legs 46. When it is desired to store the assembly, the sliding sleeves are moved to expose the hinge and allow same to pivot in a normal manner.

To store and lock the assembly, such as shown in FIG. 3, and by the directional arrows of FIGS. 1 and 2, the box-like structure 15, specifically the side members 26, may include a latching member 54 to cooperate with a latching hook 56 at the respective sides of the work bench 32. That is, once the work bench 32 is raised to lie against the box-like structure (FIG. 2), the respective latching components 54, 56 may be engaged to effect storage of the assembly.

Figure 4:
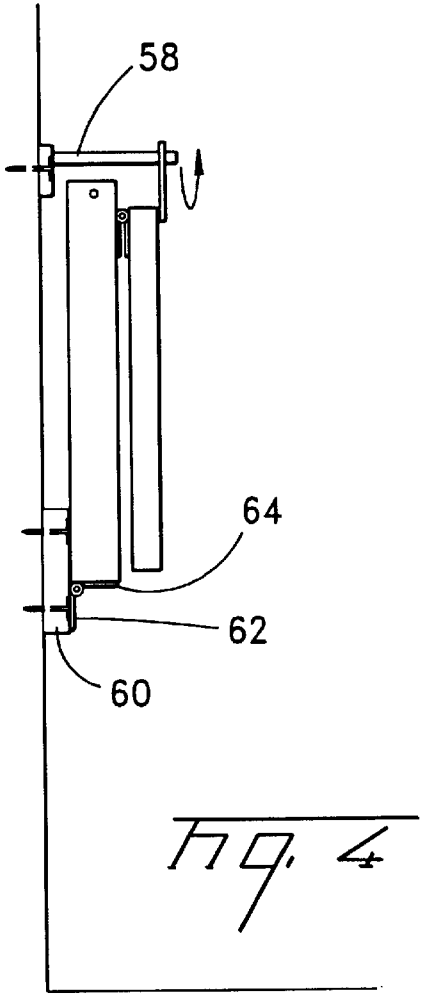
FIG. 4 is a side view, similar to FIG. 3, showing a modified work bench according to this invention.

FIG. 4 illustrates a simplified embodiment to the preferred embodiment above. Specifically, the box-like structure has been reduced in thickness, such as by the elimination of the peg-board for storing tools. Additionally, alternate means in the form of an overriding pivoting member 58 may be provided as the means to secure the assembly in the stored position. Finally, in place of the full spacer member, a wall mounted member 60 may be used, where the plural hinges 62 are secured to the member 60 and to the edge 64 of the planar work bench 66.

It is recognized that variations, modifications and changes may be made to this invention, particularly by those skilled in the art from a reading of these specifications. Accordingly, no limitations is intended to be imposed on this invention except as set forth in the appended claims.

I claim:

1. A pivotal work bench for mounting to an essentially vertical wall, said work bench comprising:

a.) a generally rectangular member to be secured to said wall and comprising a peg-board having an array of apertures for receiving plural tool mounting fixtures, a rectangular framed structure extending from a first side of said peg-board, and a spacer member attached to a second side of said peg-board for contacting said wall, whereby to allow for the easy attachment of said fixtures; and, b.) a second, generally rectangular work bench member hingedly secured to said rectangular structure, said work bench member movable from an operable work supporting position to an inoperable position in spaced relationship to said peg-board in latching engagement with said peripheral structures said work bench member further including a pair of hingedly mounted legs, each said leg having a lockable hinge support, where said hinge support comprises an overriding sleeve member to temporarily secure said legs in supporting relationship to said operable work bench member.

2. The pivotal work bench according to claim 1, wherein said box-like structure comprises a peripheral frame consisting of upper and lower horizontal members and a pair of vertical side members.

3. The pivotal work bench according to claim 2, wherein said second, generally rectangular work bench member is hingedly secured to said lower horizontal member.

4. The pivotal work bench according to claim 3 wherein said work bench member includes an upper working surface and a lower surface, and wherein said legs are hingedly mounted to said lower surface.

5. The pivotal work bench according to claim 1, including cooperative latching means between said generally rectangular member and said work bench member to secure same in a contiguous and stored position.

6. The pivotal work bench according to claim 1, wherein said array of apertures extends essentially over the entire surface of said peg-board to allow selective positioning of said fixtures thereon.

7. The pivotal work bench according to claim 1 including securement means fixed to said wall for holding said rectangular member and said work bench member in a stored position.

* * * * *